US011053941B2

(12) United States Patent
Park et al.

(10) Patent No.: US 11,053,941 B2
(45) Date of Patent: Jul. 6, 2021

(54) MOTOR-OPERATED COMPRESSOR

(71) Applicant: LG ELECTRONICS INC., Seoul (KR)

(72) Inventors: Junghoon Park, Seoul (KR); Byeongchul Lee, Seoul (KR); Kitae Jang, Seoul (KR); Jongtae Her, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 75 days.

(21) Appl. No.: 16/398,725

(22) Filed: Apr. 30, 2019

(65) Prior Publication Data

US 2019/0338775 A1 Nov. 7, 2019

(30) Foreign Application Priority Data

May 4, 2018 (KR) ..... 10-2018-0051965

(51) Int. Cl.
*F04C 23/00* (2006.01)
*F04C 14/24* (2006.01)

(52) U.S. Cl.
CPC ..... *F04C 23/005* (2013.01); *F04C 14/24* (2013.01); *F04C 23/008* (2013.01); *F04C 2240/30* (2013.01); *F04C 2240/40* (2013.01); *F04C 2240/54* (2013.01)

(58) Field of Classification Search
CPC .... F04C 18/0215; F04C 29/02; F04C 29/023; F04C 2240/50; F04C 2240/603
USPC ..... 418/55.1, 55.2
See application file for complete search history.

(56) References Cited

U.S. PATENT DOCUMENTS 6,030,192 A * 2/2000 Hill ..... F04C 18/0215 418/55.2
2006/0177333 A1* 8/2006 Sakuda ..... F16C 33/78 418/55.3
2008/0069713 A1 3/2008 Ignatiev et al.
2017/0037850 A1* 2/2017 Ignatiev ..... F04C 27/008
(Continued)

FOREIGN PATENT DOCUMENTS

JP H07259756 A 10/1995
JP H07332264 A 12/1995
KR 2013-0031737 A 3/2013
(Continued)

OTHER PUBLICATIONS

European Search Report dated Sep. 19, 2019.

*Primary Examiner* — Patrick Hamo
(74) *Attorney, Agent, or Firm* — Finnegan, Henderson, Farabow, Garrett & Dunner, LLP

(57) ABSTRACT

A motor-operated compressor includes a housing and a driving motor disposed in an inner space of the housing. The driving motor includes a stator and a rotor. A rotary shaft is coupled to the rotor. A first scroll is provided on one side of the driving motor and the rotary shaft passes through and is rotatably coupled to the first scroll. A second scroll is coupled to the first scroll and an eccentric part of the rotary shaft passing through the first scroll to form a compression chamber between the first scroll and the second scroll. A frame is provided opposite to the driving motor with the first scroll and the second scroll interposed therebetween and configured to axially support the second scroll and radially support one end of the rotary shaft passing through the second scroll.

15 Claims, 11 Drawing Sheets

(56) References Cited

U.S. PATENT DOCUMENTS

2018/0066656 A1* 3/2018 Perevozchikov ... F04C 18/0253

FOREIGN PATENT DOCUMENTS

KR 2014-0112817 A 9/2014
KR 2014-0136797 A 12/2014

* cited by examiner

MOTOR-OPERATED COMPRESSOR

CROSS-REFERENCE TO RELATED APPLICATION

Pursuant to 35 U.S.C. § 119(a), this application claims the benefit of earlier filing date and right of priority to Korean Application No. 10-2018-0051965, filed on May 4, 2018, the contents of which are incorporated by reference herein in their entirety.

BACKGROUND OF THE INVENTION

1. Field of the Invention

The present invention relates to a motor-operated compressor.

2. Background of the Invention

Among various compression methods, a scroll compression method suitable for high compression ratio operation is mainly applied to motor operated compressors. In a scroll-type motor-operated compressor, a motor part having a rotary motor is installed inside a sealed casing, and a compression part composed of a stationary scroll and an orbiting scroll is installed on one side of the motor part. The motor part and the compression part are connected to each other by a rotary shaft to transfer the rotational force of the motor part to the compression part. The rotational force transferred to the compression unit enables the orbiting scroll to orbit around the fixed scroll so that a pair of two compression chambers each composed of a suction chamber, a middle pressure chamber, and a discharge chamber are formed and also refrigerant is suctioned into both of the compression chambers and then compressed and discharged at the same time.

A scroll-type compressor applied to an automobile air conditioning system is mainly installed in a horizontally long shape because of the structure of an automobile engine room. The motor part and the compression part are arranged in a horizontal direction and connected to the rotary shaft. Thus, a main frame and a subframe for supporting the rotary shaft are horizontally provided on both sides of the motor part, and a main bearing is provided in the main frame to support a central portion of the rotary shaft. A sub-bearing is provided in the subframe to support one end of the rotary shaft.

In this motor-operated compressor, a discharge space is formed on the bottom surface of the stationary scroll, with the main frame, the orbiting scroll, and the stationary scroll being arranged in order with respect to the motor part, and this discharge space is sealed by a rear housing forming a casing.

However, since the conventional motor-operated compressor has a rear housing forming a discharge space on one side of the compression part including the stationary scroll, the number of components constituting the compressor may be increased, and also the size and weight of the compressor may be increased. This may be a very unfavorable condition, considering that motor-operated compressors are mainly applied to vehicles.

Also, the conventional motor-operated compressor requires a separate oil separator because oil has to be separated in the discharge space, thus increasing the number of components.

Further, the conventional motor-operated compressor axially supports the orbiting scroll only by a back pressure space or an intermediate pressure space formed between the main frame and the orbiting scroll. In this case, however, when a back pressure for the orbiting scroll is low, for example, when the compressor is activated, the orbiting scroll cannot be sufficiently supported, thus resulting in axial leakage.

Also, the conventional motor-operated compressor could be disadvantageous in expanding compression capacity because the stationary scroll is to be inserted into a casing and thus has a limited outer diameter under the condition that the outer diameter of the compressor is constant.

SUMMARY OF THE INVENTION

Therefore, an aspect of the detailed description is to provide a motor-operated compressor capable of reducing the number of components and also the size of the compressor.

Also, the present invention provides a motor-operated compressor capable of simplifying a member for supporting a stationary scroll and an orbiting scroll to reduce the number of components and also the size of the compressor.

Also, the present invention provides a motor-operated compressor capable of removing a conventional rear housing by placing an orbiting scroll farther from a driving motor than a stationary scroll so that a member for supporting the orbiting scroll toward the stationary scroll may form a portion of a casing.

Also, the present invention provides a motor-operated compressor capable of easily separating oil from refrigerant discharged from a compression chamber without having a separate oil separator.

Also, the present invention provides a motor-operated compressor capable of enabling refrigerant compressed in a compression chamber to be discharged to a motor chamber.

Also, the present invention provides a motor-operated compressor capable of enabling a discharge pipe to be provided opposite to a compression chamber with respect to a driving motor so that oil is separated from refrigerant discharged to the motor chamber while the refrigerant is passing through the driving motor.

Also, the present invention provides a motor-operated compressor capable of suppressing axial leakage by stably supporting an orbiting scroll in an axial direction.

Also, the present invention provides a motor-operated compressor having an elastic member between an orbiting scroll and a member for supporting the orbiting scroll.

Also, the present invention provides a motor-operated compressor capable of increasing compression capacity relative to the constant outer diameter of the housing.

Also, the present invention provides a motor-operated compressor capable of increasing compression capacity by exposing an external peripheral surface of a stationary scroll to the outside so that the outer diameter of the stationary scroll may be increased.

To achieve these and other advantages and in accordance with the purpose of this specification, as embodied and broadly described herein, there is provided a motor-operated compressor including a compression part including a stationary scroll and an orbiting scroll; a housing provided on one side of the compression part and configured to form a discharge space to accommodate refrigerant discharged from the compression part; and a frame provided on another side of the compression part to form a casing together with the housing.

Here, a discharge port for discharging compressed refrigerant may communicate with the compression part toward a discharge space of the housing.

Also, a driving motor may be provided in the discharge space, a rotor to which the rotary shaft is to be connected may be provided in the driving motor.

An oil passage may be formed in the rotary shaft, and an oil supply passage for communicating between the discharge space and the oil passage may be formed in the frame.

In order to achieve the objectives of the present invention, there is also provided a motor-operated compressor including a housing; a driving motor provided in an inner space of the housing, the driving motor having a stator and a rotor; a rotary shaft coupled to the rotor; a first scroll provided on one side of the driving motor, the rotary shaft passing through and rotatably coupling to the first scroll; a second scroll coupled to the first scroll and coupled to an eccentric part of the rotary shaft passing through the first scroll to form a compression chamber between the first scroll and the second scroll; and a frame provided opposite to the driving motor with the first scroll and the second scroll interposed therebetween and configured to axially support the second scroll and radially support one end of the rotary shaft passing through the second scroll.

Here, a discharge port may be formed in the first scroll to discharge refrigerant compressed in the compression chamber, and the discharge port may communicate with the inner space of the housing.

Also, bearings forming bearing surfaces together with an outer peripheral surface of the rotary shaft may be provided in the first scroll, the second scroll, and the frame, and an oil flow path and an oil supply hole may be formed in the rotary shaft to supply oil to the bearing surfaces.

Also, the oil flow path may be formed lengthwise on one end of the rotary shaft, and an oil supply passage communicating between the oil flow path and the inner space of the housing may be formed to pass through the first scroll and the frame.

Also, the oil supply passage may include a first oil supply passage formed to pass through the first scroll; and a second oil supply passage formed to pass through the frame, the second oil supply passage communicating with the first oil supply passage.

Also, a shaft support part radially supporting one end of the rotary shaft may be formed in the frame, and the second oil supply passage may communicate with the oil flow path through the shaft support path.

Also, a sealing member may be provided between the first oil supply passage and the second oil supply passage.

Also, an intermediate pressure space may be formed between the second scroll and the frame, and the oil supply passage may be separated from the intermediate pressure space.

Also, an intermediate pressure space may be formed between the second scroll and the frame, and the oil supply passage may communicate with the intermediate pressure space.

Here, an elastic member may be provided between the second scroll and the frame to elastically support the second scroll toward the first scroll.

A support surface having a predetermined height from an inner surface of the frame may be formed stepwise in the frame to support an outer periphery of the elastic member.

Also, a protrusion and a groove may be provided between the frame and the elastic member so that the elastic member is fastened to the frame.

Also, the elastic member may be fluidly provided between the second scroll and the frame.

Here, an intermediate pressure space may be formed between the second scroll and the frame, and the intermediate pressure space may communicate with the compression chamber.

Also, a balance weight coupled to the rotary shaft may be accommodated in the intermediate pressure space.

Here, the first scroll may have one axial surface to which the housing is coupled and another axial surface to which the frame is coupled.

Also, the first scroll may have an outer diameter greater than or equal to an inner diameter of the housing or an inner diameter of the frame.

Here, the first scroll may have an outer peripheral surface coupled to an inner surface of the housing or an inner peripheral surface of the frame.

In order to achieve the objectives of the present invention, there is also provided a motor-operated compressor including: a first scroll; a second scroll configured to orbit in engagement with the first scroll to form a compression is chamber; a rotary shaft eccentrically coupled to the second scroll through the first scroll; a driving motor coupled to the rotary shaft and configured to generate a rotational force to rotate the rotary shaft; and a casing including a housing provided on one axial side of the first scroll and a frame provided on another axial side of the first scroll, wherein the housing has an inner space for accommodating the driving motor, and the inner space communicates with a discharge side of the compression chamber to accommodate refrigerant discharged from the chamber, and the frame axially supports the second scroll and radially support one end of the rotary shaft passing through the second scroll.

Here, an oil flow path and a oil supply hole may be formed in the rotary shaft to supply oil to a bearing radially supporting the rotary shaft, and an oil supply passage may be formed in the first scroll and the frame to guide oil separated from the refrigerant in the inner space of the housing to the oil flow path and the oil supply hole of the rotary shaft.

Advantageous Effects of the Invention

In the motor-operated compressor according to the present invention, the stationary scroll, the orbiting scroll, and the frame may be sequentially arranged on one side of the drive motor, so that the frame can be utilized as a portion of the casing. Thus, it is possible to decrease the number of components constituting the casing, thereby reducing the manufacturing cost and size of the compressor to implement lightening of the compressor.

Also, in the motor-operated compressor according to the present invention, refrigerant and oil discharged from the compression chamber may be smoothly separated from each other while the discharged refrigerant and oil pass through the inner space of the housing accommodating the driving motor. As a result, the refrigerant and the oil may be easily separated from each other without providing a separate oil separator, and thus it is possible to reduce the manufacturing cost and prevent oil shortage in the compressor.

Also, the motor-operated compressor according to the present invention may have the elastic member provided between the orbiting scroll and the frame to stably support the axial direction of the orbiting scroll, and thus it is possible to effectively support axial leakage in the compression chamber.

Also, the motor-operated compressor according to the present invention may have the stationary scroll, which forms the compression part, being exposed to outside of the housing, and it is possible to enlarge the diameter of the compression part with respect to the constant volume of the compressor. This can increase the compression capacity.

DETAILED DESCRIPTION OF THE INVENTION

Hereinafter, a motor-operated compressor according to the present invention will be described in detail with reference to an embodiment shown in the accompanying drawings.

Figure 1:
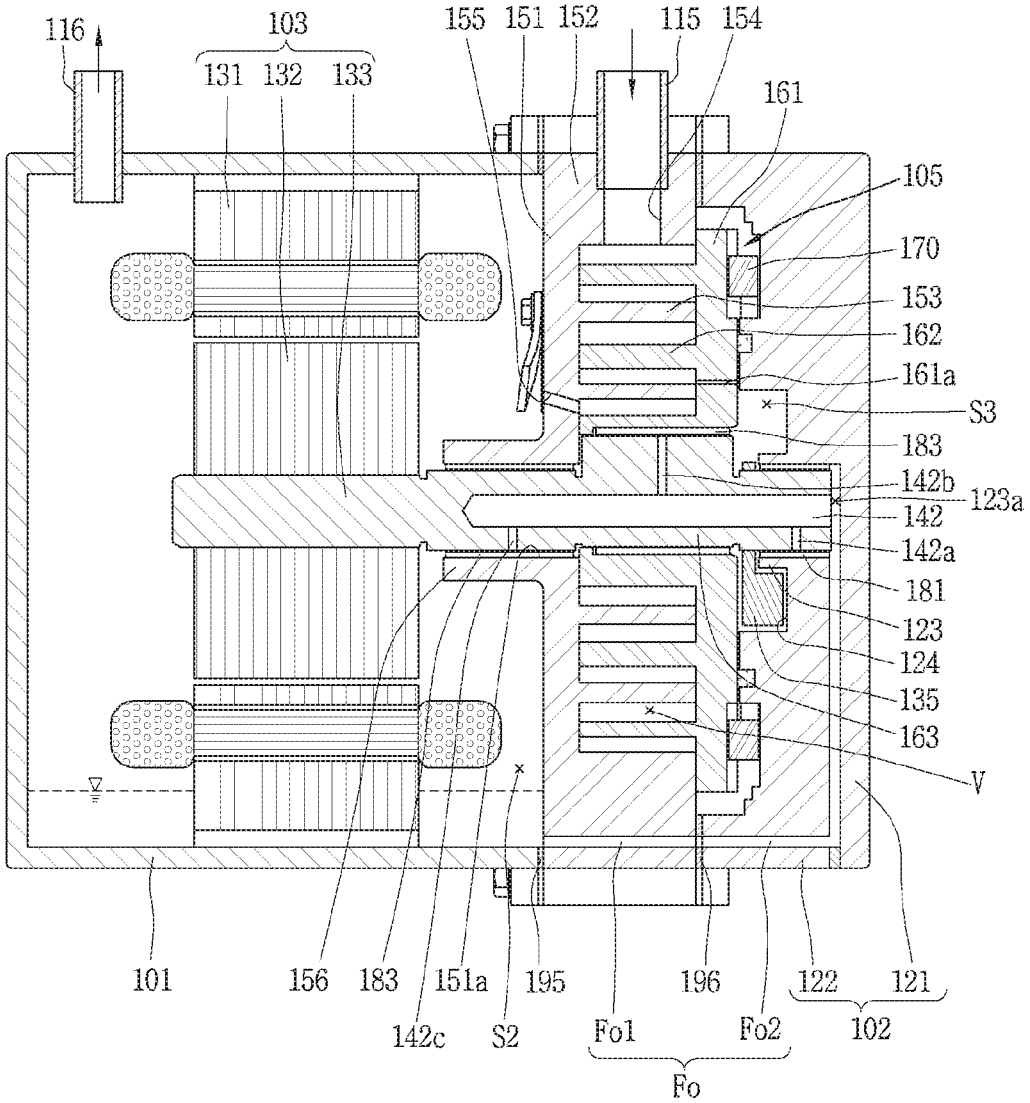
FIG. 1 is a cross-sectional view showing the inside of a motor-operated compressor according to the present invention.
Figure 2:
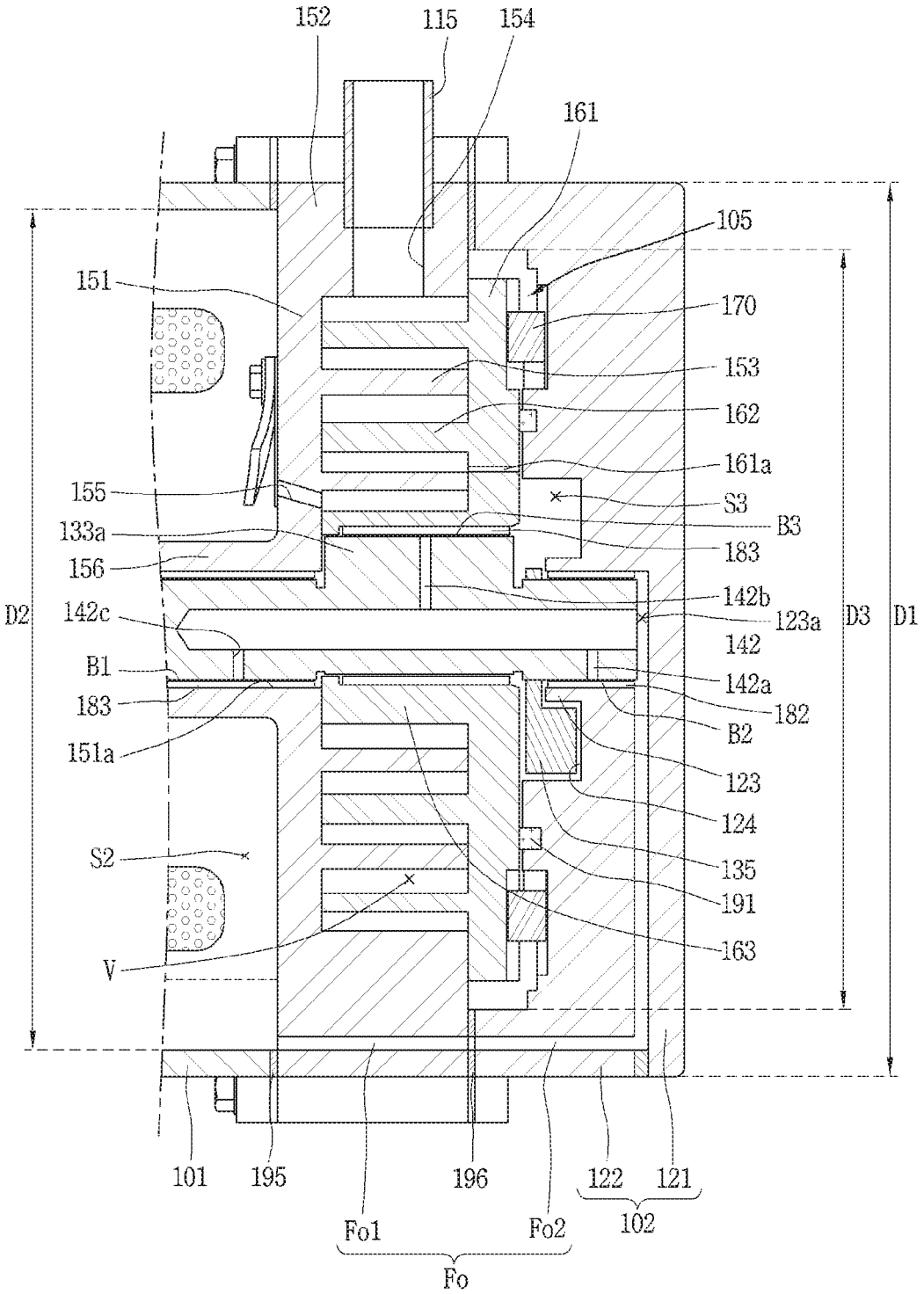
FIG. 2 is an enlarged cross-sectional view showing the vicinity of a compression part of FIG. 1.

FIG. 1 is a cross-sectional view showing the inside of a motor-operated compressor according to the present invention, and FIG. 2 is an enlarged cross-sectional view showing the vicinity of a compression part of FIG. 1.

As shown, a motor scroll compressor (hereinafter abbreviated as a motor-operated compressor) according to this embodiment includes a driving motor 103 which is a motor part fastened to the inside of a housing 101, a compression part provided on one side of the driving motor 103 and configured to compress refrigerant using the rotational force of the driving motor 103, and a frame 102 provided on one side of the compression part 105 and configured to support the compression part 105, the frame 102 serving as a casing together with the housing 101. This motor-operated compressor forms a high-pressure compressor as refrigerant discharged from the compression part 105 is discharged to the outside through an inner space of the housing 101.

The housing 101 is placed in a horizontal direction with respect to a ground surface, and thus the driving motor 103 and the compression part 105 are arranged in the horizontal direction. For convenience, in the following description, the left of FIG. 1 is designated as a front side, and the right of FIG. 1 is designated as a rear side.

The housing 101 is formed in a cap section shape having a closed front end and an opened rear end. An exhaust port (not shown) to which a discharge pipe 116, which will be described below, is to be connected is formed on the closed front end side. A front side of a scroll side wall 152, which is a first surface of a stationary scroll 150, is adhered to the opened rear end with a first sealing member 195 interposed therebetween. Thus, the inner space of the housing 101 is sealed, and the driving motor 103, which has been described above, is coupled to the sealed inner space of the housing 101.

The driving motor 103 includes a stator 131 inserted into and fastened to an inner peripheral surface of the housing 101 and a rotor 132 placed inside the stator 131 and rotated by interaction with the stator 131. A rotary shaft 133 configured to transfer the rotational force of the driving motor 103 to the compression part 105 while rotating together with the rotor 132 is coupled to the rotor 132.

The compression part 105 includes a stationary scroll (hereinafter referred to as a first scroll) 150 coupled to the rear end, which is the open side of the housing as described above, and an orbiting scroll (hereinafter referred to as a second scroll) 160 forming a pair of two chambers V between the first scroll 150 and the second scroll 160 while orbiting in engagement with the first scroll 150. The second scroll 160 is axially supported by the frame 102, which will be described below, and an oldham ring 170 is provided between the frame 102 and the second scroll 160 as an anti-rotation mechanism for preventing rotation of the second scroll 160. A pin and ring as well as the oldham ring may be used as the anti-rotation mechanism.

In the first scroll 150, a stationary scroll end plate (hereinafter referred to as a stationary end plate) 151 is formed in a substantially disc shape, and a stationary scroll side wall (hereinafter referred to as a scroll side wall) 152 to be coupled to a frame side wall 122 is formed at an edge of the stationary end plate 151. A stationary wrap 153 forming the compression chamber V in engagement with an orbiting wrap 162 to be described below is formed on a rear surface of the stationary end plate 151.

A shaft hole 151*a* through which the rotary shaft 133 is to pass is formed at the center of the stationary end plate 151. A first shaft support part 156 extending a predetermine height toward the driving motor 103 is formed in the vicinity of one surface of the shaft hole 151*a*, and a first bearing 181, which is a bush bearing, is inserted into and coupled to an inner peripheral surface of the first shaft support part 156.

A suction port 154 is formed on one side of the scroll side wall 152 to communicate with a suction chamber (not shown). A discharge port 155 communicating with a discharge chamber (not shown), which is a final compression chamber, to discharge compressed refrigerant into the inner space of the housing 101, which is a discharge space, is formed at a center portion of the stationary end plate 151. Thus, the wide inner space of the housing in which the driving motor is provided may be utilized as a kind of oil separation space. Thus, oil may be easily separated from refrigerant without a separate oil separator.

The suction port 154 may be radially or horizontally formed to pass through an outer peripheral surface of the scroll side wall 152 toward the suction chamber, and a suction pipe 115 extending from an outlet of an evaporator or an outlet of an accumulator in a refrigeration cycle may be inserted into or coupled to the suction port 154. Thus, as shown in FIG. 2, the scroll side wall 152 of the first scroll 150 has an outer peripheral surface located outside the housing 101 or the frame 102. That is, the outer diameter D1 of the first scroll 150 may be greater than or equal to the inner diameter D2 of the housing 101 or the inner diameter D3 of the frame 102. Thus, the outer diameter of the first scroll may be increased with respect to the constant outer diameter of the compressor. Accordingly, the suction volume of the compression chamber may be increased by increasing the winding length of the stationary wrap and the orbiting wrap.

Also, the discharge port 155 may be formed axially or obliquely with respect to the stationary end plate 151 to pass from the compression chamber V toward a discharge space S2. Only one discharge port 155 may be formed to communicate with both of a compression chamber V1 and a second compression chamber V2, which will be described below. A first discharge port 155*a* and a second discharge port 155*b* may be formed to communicate with the first compression chamber V1 and the second compression chamber V2, respectively.

In the second scroll 160, an orbiting scroll end plate (hereinafter referred to as an orbiting end plate) 161 is formed in a substantially disc shape, and an orbiting wrap 162 constituting the compression chamber in engagement with the stationary wrap 153 is formed on the front surface of the orbiting end plate 161. The orbiting wrap 162 as well as the stationary wrap 153 may be formed in an involute shape, but may be formed in various other shapes. The shape of the orbiting wrap 162 will be described below with reference to FIG. 2 in addition to that of the stationary wrap 153.

Figure 3:
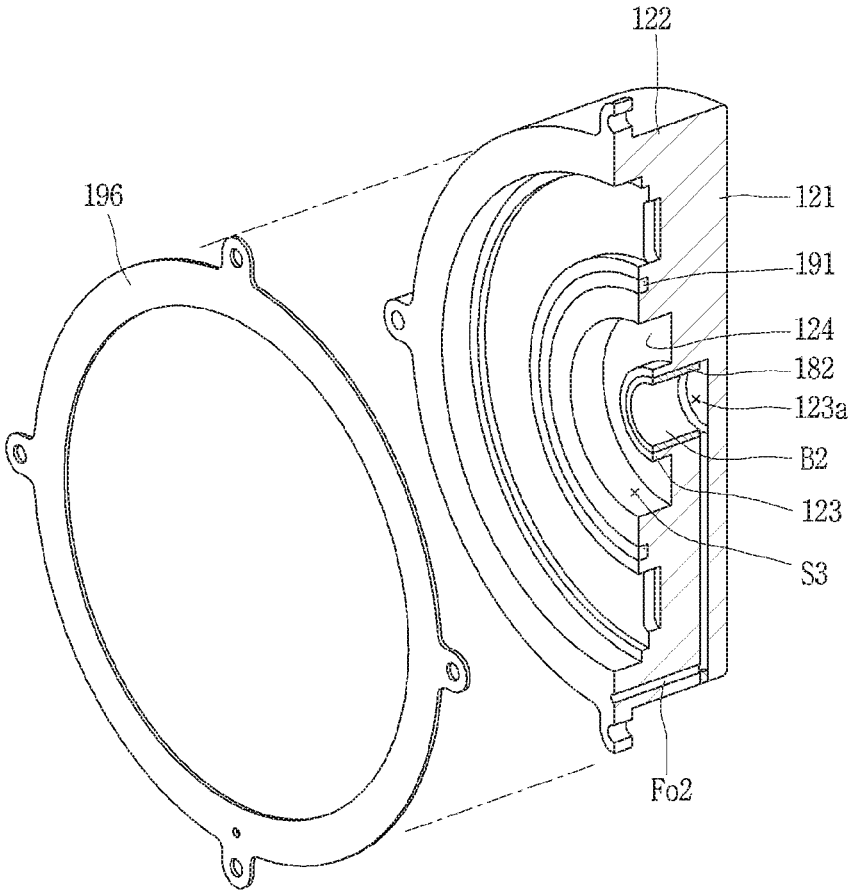
FIG. 3 is an exploded perspective view showing the inner surface of a frame according to this embodiment.

The frame 102 is coupled and fastened to the scroll side wall 152, which is a second surface of the first scroll 150. Thus, the frame 102 serves as a kind of casing such as the rear housing. FIG. 3 is an exploded perspective view showing the inner surface of a frame according to this embodiment.

Like FIG. 3, as described above, the frame 102 is placed opposite to the driving motor 103 with the compression part 105 interposed therebetween, and axially supports the second scroll 160.

A frame end plate 121 is formed on the frame 102 in a disc shape. A frame side wall 122 is formed at a front edge of the frame end plate 121 so that the side wall 152 of the first scroll 150 may be coupled to the frame side wall 122, and a second shaft support part 123 is formed at a front center portion of the frame end plate 121 so that a compression part side end of the rotary shaft 133 may be inserted into the second shaft support part 123 and radially supported by a second bearing 182, which will be described below.

Also, an intermediate pressure space forming a kind of back pressure space is formed in the vicinity of the second shaft support part 123, that is, the front surface of the frame 102. For example, a space part 124 may be formed in the vicinity of the second shaft support part 123 to accommodate a balance weight 135 coupled to the rotary shaft 133. The space part 124 communicates with a space formed inside an intermediate pressure forming member 191 among spaces between surfaces corresponding to the second scroll 160 and the frame 102. The space formed inside the intermediate pressure forming member 191 communicates with an intermediate pressure hole 161*a* provided in the orbiting end plate 161 of the second scroll 160. Thus, a portion of refrigerant or oil introduced into and compressed in the compression chamber moves due to a difference in pressure between the compression chamber and the intermediate pressure space, and the pressure in the intermediate pressure space forms back pressure supporting the second scroll toward the first scroll.

Meanwhile, an oil supply passage communicating with the discharge space S2 and allowing oil separated in the discharge space S2 is guided to bearing surfaces B1, B2, and B3 through the rotary shaft is formed in an inner space 123*a* of the second shaft support part 123. An oil supply structure including the oil supply passage will be described again later.

When power is applied to the driving motor 103 of the scroll compressor, the rotary shaft 133 rotates along with the rotor 132 to transfer a rotational force to the second scroll 160, and the second scroll 160 is orbited by the oldham ring 170. Thus, the compression chamber V is continuously moved toward the center, thereby decreasing the volume of the compression chamber V.

Then, the refrigerant is suctioned into the compression chamber V through a suction port 101*a* and the suction port 154.

Then, this refrigerant is compressed by the first scroll 150 and the second scroll 160 and discharged into the discharge space S2. In the discharge space S2, oil is separated from the refrigerant. The refrigerant is discharged to a refrigeration cycle through the exhaust port (not shown) while the oil is supplied to the compression chamber and bearing surfaces through an oil supply passage, which will be described below. The series of processes are repeated.

The weight of the scroll compressor according to this embodiment may be advantageously reduced, considering that the scroll compressor is mainly applied to vehicles in nature. However, a conventional scroll compressor requires a rear housing for accommodating refrigerant discharged from the compression part because a main frame and a compression part are sequentially arranged on one side of the driving motor. Thus, the length and also weight of the compressor are increased.

In view of this, according to the present embodiment, it is possible to eliminate the conventional rear housing by sequentially arranging a compression part and a frame on one side of a driving motor to allow the frame to serve as the rear housing. This may reduce the length of the compressor as much as the rear housing, thus reducing the weight of the compressor.

To this end, a method of coupling to the second scroll, which is an orbiting scroll, through the first scroll, which is a stationary scroll, i.e., a so-called shaft-through scroll compressor method must be applied to one end (the compression side end) of the rotary shaft.

Typically, in a shaft-through scroll compressor, a final compression chamber is formed eccentrically from the center of the scroll. Accordingly, when the stationary wrap and the orbiting wrap are formed in an involute shape, the pressure of one compression chamber is significantly lower than that of another compression chamber.

Figure 4:
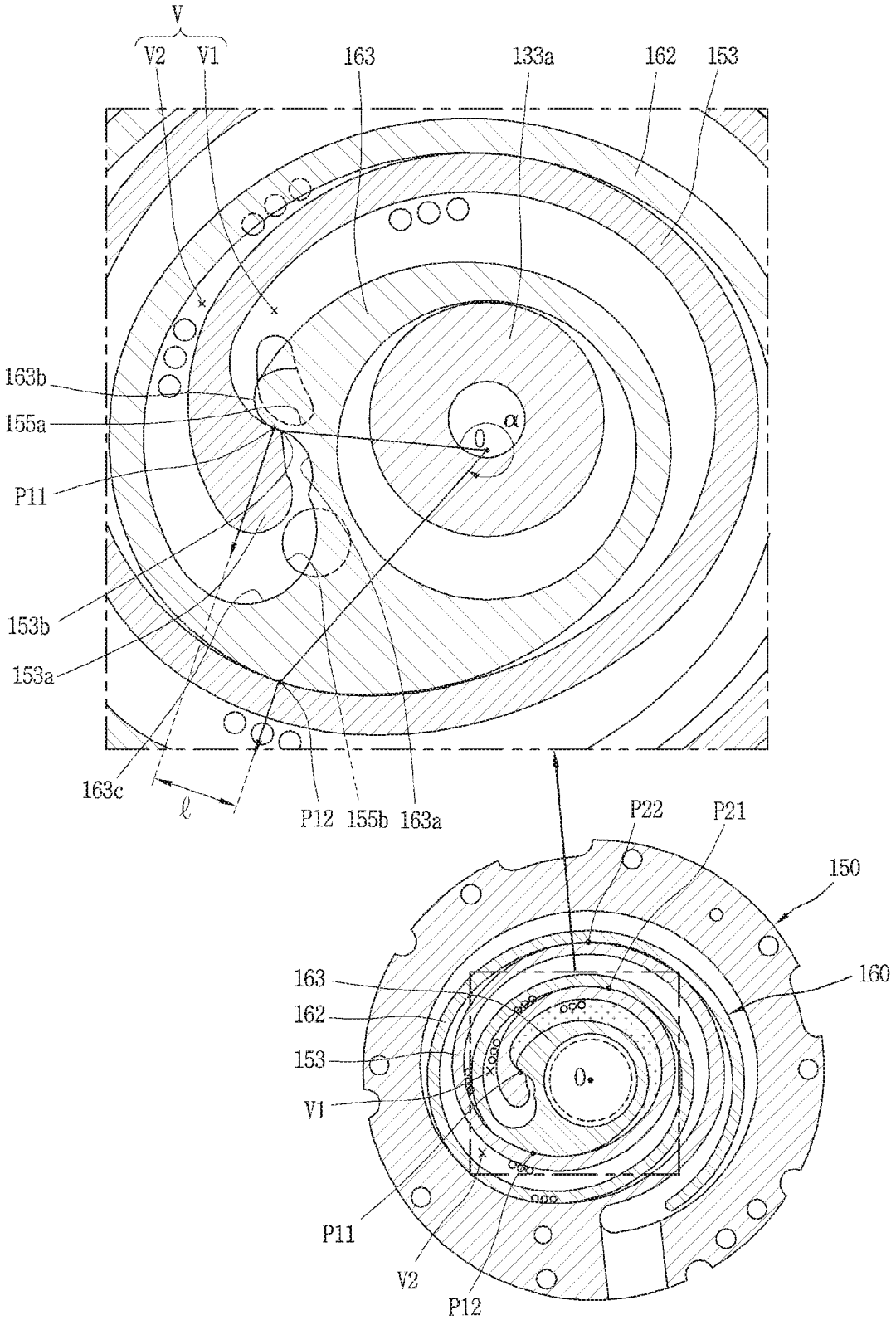
FIG. 4 is a cross-sectional view showing the compression part in FIG. 1 and also is a plan view for illustrating a coupling relationship between a stationary scroll and an orbiting scroll.

Therefore, for the shaft-through scroll compressor, the stationary wrap and the orbiting wrap may be formed in a non-involute shape. FIG. 4 is a cross-sectional view showing the compression part in FIG. 1 and also is a plan view for illustrating a coupling relationship between the stationary scroll and the orbiting scroll.

As shown, the orbiting wrap 162 may have a form in which multiple arcs having different diameters and origins are connected to one another and may have an outermost curve formed in a substantially oval shape with a major axis and a minor axis. The stationary wrap 153 may also be formed in such a way.

A rotary shaft coupling part 163 forming an inner end of the orbiting wrap 162 into which an eccentric part 133*a* of the rotary shaft 133 may be axially formed to pass through a center portion of the orbiting end plate 161, and an eccentric part 133*a* of the rotary shaft 133 is rotatably inserted into and coupled to the rotary shaft coupling part 163. A third bearing 183, which is a bush bearing, may be inserted into and fastened to the inner peripheral surface of the rotary shaft coupling part 163. The outer peripheral part of the rotary shaft coupling part 163 is connected to the orbiting wrap 162 to form the compression chamber V together with the stationary wrap 153 during the compression process.

Also, the rotary shaft coupling part 163 may be formed to a height overlapping and co-planar with the orbiting wrap 162, and eccentric part 133*a* of the rotary shaft 133 may be placed at a height overlapping and co-planar with the orbiting wrap 162. As a result, the repulsive force and the compressive force of refrigerant are canceled each other while being applied to the same plane with respect to the orbiting end plate, and thus it is possible to prevent the inclination of the second scroll 160 due to the action of the compressive force and the repulsive force.

Also, a recess 163*a* to be engaged with a protrusion 153*a* of the stationary wrap 153, which will be described below, is formed on the outer peripheral part of the rotary shaft coupling part 163 opposite to an inner end of the stationary wrap 153. An increasing part 163*b* in which a thickness increases from the inner peripheral portion of the rotary shaft coupling part 163 up to the outer peripheral portion of the rotary shaft coupling part 163 in the upper stream in a formation direction of the compression chamber V is formed on one side of the recess 163*a*. Thus, the compression path of the first compression chamber V1 immediately before discharge is lengthened. As a result, it is possible to increase the compression ratio of the first compression chamber V1 almost up to the compression ratio of the second compression chamber V2.

An arc compression surface 163*c* having an arc shape is formed on another side of the recess 163*a*. The diameter of the arc compression surface 163*c* is determined by the thickness of the inner end of the stationary wrap 153 (i.e., the thickness of a discharge end) and the orbiting radius of the orbiting wrap 162. The diameter of the arc compression surface 163*c* increases as the thickness of the inner end of the stationary wrap 153 increases. As a result, it is possible to ensure durability due to the increase in the thickness of the orbiting wrap around the arc compression surface 163*c*, and it is also possible to increase the compression ratio of the second compression chamber V2 correspondingly due to the extension of the compression path.

Also, a protrusion 153*a* protruding toward the outer peripheral portion of the rotary shaft coupling part 163 is formed near the inner end (a suction end or a start end) of the stationary wrap 153 corresponding to the rotary shaft coupling part 163. A contact part 153*b* protruding from the protrusion 153*a* and engaging with the recess 163*a* may be formed on the protrusion 153*a*. That is, the inner end of the stationary wrap 153 may have a greater thickness than the other parts. As a result, it is possible to improve the wrap strength at the inner end of the stationary wrap 153 to which the greatest compressive force is applied, and thus to improve the durability.

Meanwhile, the compression chambers V may be formed between the stationary end plate 151 and the stationary wrap 153 and between the orbiting wrap 162 and the orbiting end plate 161. Each of the compression chambers V may be configured by sequentially forming the suction chamber, the intermediate pressure chamber, and the discharge chamber along the traveling direction of the wrap.

The compression chambers V may consist of the first compression chamber V1 formed between the inner surface of the stationary wrap 153 and the outer surface of the orbiting wrap 162 and the second compression chamber V2 formed between the outer surface of the stationary wrap 153 and the inner surface of the orbiting wrap 162. That is, the first compression chamber V1 includes a compression chamber that is formed between two contact points P11 and P12 generated by the inner surface of the stationary wrap 153 and the outer surface of the orbiting wrap 162 brought into contact with each other, and the second compression chamber V2 includes a compression chamber that is formed between two contact points P21 and P22 generated by the outer surface of the stationary wrap 153 and the inner surface of the orbiting wrap 162 brought into contact with each other.

Here, for the first compression chamber V1 immediately before discharge, when the larger one between angles formed by two lines connecting the center of the eccentric part, that is, the center O of the rotary shaft coupling part to the two contact points P11 and P12 is $\alpha$, $\alpha<360°$ at least immediately before the discharge, and a distance I between normal vectors at the two contact points P11 and P12 is greater than 0.

Since the first compression chamber immediately before discharge has a smaller volume when the stationary wrap and the orbiting wrap according to this embodiment have smaller volumes are used than when a stationary wrap and an orbiting wrap formed in an involute curve are used, it is possible to improve both of the compression ratio of the first compression chamber V1 and the compression ratio of the second compression chamber V2 without increasing the sizes of the stationary wrap 153 and the orbiting wrap 162.

An oil supply structure for supplying oil to bearings in a scroll compressor in which a compression part and a frame are sequentially arranged on one side of a driving motor, as described above, will be described below.

Referring to FIGS. 1 and 2 again, a second shaft support part 123 is formed in a cylindrical shape at the center of the inner surface of the frame 102, that is, an inner surface facing the second scroll 160 so that the compression part side end of the rotary shaft 133 may be inserted into and radially supported by the second shaft support part 123. The inner space 123*a* of the second shaft support part 123 may communicate with the inner space of the housing 101, that is, the discharge space S2 through an oil supply passage.

The second bearing 182, which is a bush bearing, may be inserted into and coupled to the inner peripheral surface of the second shaft support part 123. However, a needle bearing instead of the bush bearing may be used as the second bearing 182.

The oil supply passage Fo may consist of a first oil supply passage Fo1 passing through the scroll side wall 152 of the first scroll and a second oil supply passage Fo2 passing through the frame end plate 121 and the frame side wall 122 of the frame 102. The first oil supply passage Fo1 communicates with the discharge space S2 of the housing 101. The second oil supply passage Fo2 has one end communicating with the first oil supply passage Fo1 and another end communicating with the inner space 123*a* of the second shaft support part 123. Thus, the oil of the discharge space S2 moves to the inner space 123*a* of the second shaft support part 123 through the first oil supply passage Fo1 and the second oil supply passage Fo2.

A gap between the first oil supply passage Fo1 and the second oil supply passage Fo2 may be sealed by a second sealing member 196 so that the oil supply passage Fo may be separated from the intermediate pressure space S3. However, the oil of the discharge space S2 is depressurized due to the small inner diameter of the first oil supply passage Fo1 while the oil is moving to the first oil supply passage Fo1. Accordingly, discharge pressure in the intermediate pressure space S3 does not excessively rise or fall even when the oil supply passage Fo finely communicates with the intermediate pressure space S3. Therefore, the gap between the first oil supply passage Fo1 and the second oil supply passage Fo2 may communicate with the intermediate pressure space S3. This case may be advantageous to increase the back pressure in the intermediate pressure space when the compressor is activated.

Also, an oil flow path 142 constituting a portion of the oil supply passage Fo is formed inside the rotary shaft 133, and a plurality of oil supply holes 142*a*, 142*b*, and 142*c* are formed lengthwise in the middle of the oil flow path 142 at regular intervals.

The oil flow path 142 may be formed up to an intermediate position of the rotary shaft 133.

The plurality of oil supply holes 142*a*, 142*b*, and 142*c* may be formed in the oil flow path 142 to radially pass through the rotary shaft 133 toward the inner peripheral surfaces of the bearings 181, 182, and 183. Based on the order in which oil is supplied, the plurality of oil supply holes 142*a*, 142*b*, and 142*c* may be classified as a first oil supply hole 142*a* formed within the range of the second bearing 182, a second oil supply hole 142*b* formed within the range of the third bearing 183, and a third oil supply hole 142*c* formed within the range of the first bearing 181. Also, the bearing surfaces formed on the inner peripheral surfaces of the bearings 181, 182, and 183 may be classified as first, second, and third bearing surfaces B1, B2, and B3.

Meanwhile, a pressure reducing part may be formed in the oil supply passage Fo. That is, the oil supply passage Fo has an entrance communicating with the discharge space S2, which is a high pressure part, and an exit communicating with the oil flow path 142, which is a low pressure part. Thus, when the pressure reducing part is not provided in the oil supply passage Fo, the oil of the discharge space S2 may excessively flow from the discharge space S2 into the oil flow path 142, and this oil may be suctioned into the compression chamber V, thereby resulting in suction loss.

Accordingly, a pressure reducing member (not shown) such as a pressure reducing bar is inserted into the oil flow path 142 constituting the oil supply passage Fo to narrow the inner diameter of the oil flow path 142, thereby lowering the pressure of oil passing through a pressure reducing section to an intermediate pressure. The pressure reducing member may be placed not only inside the rotary shaft 133 but also anywhere in the upper stream with respect to the oil supply holes 142*a* and 142*b*.

However, as described above, the oil supply passage Fo consists of the first oil supply passage Fo1 and the second oil supply passage Fo2, and thus the whole length of the oil supply passage Fo increases. Therefore, by decreasing the inner diameters of the first oil supply passage Fo1 and the second oil supply passage Fo2, oil may be depressurized through the oil supply passage Fo.

Figure 5:
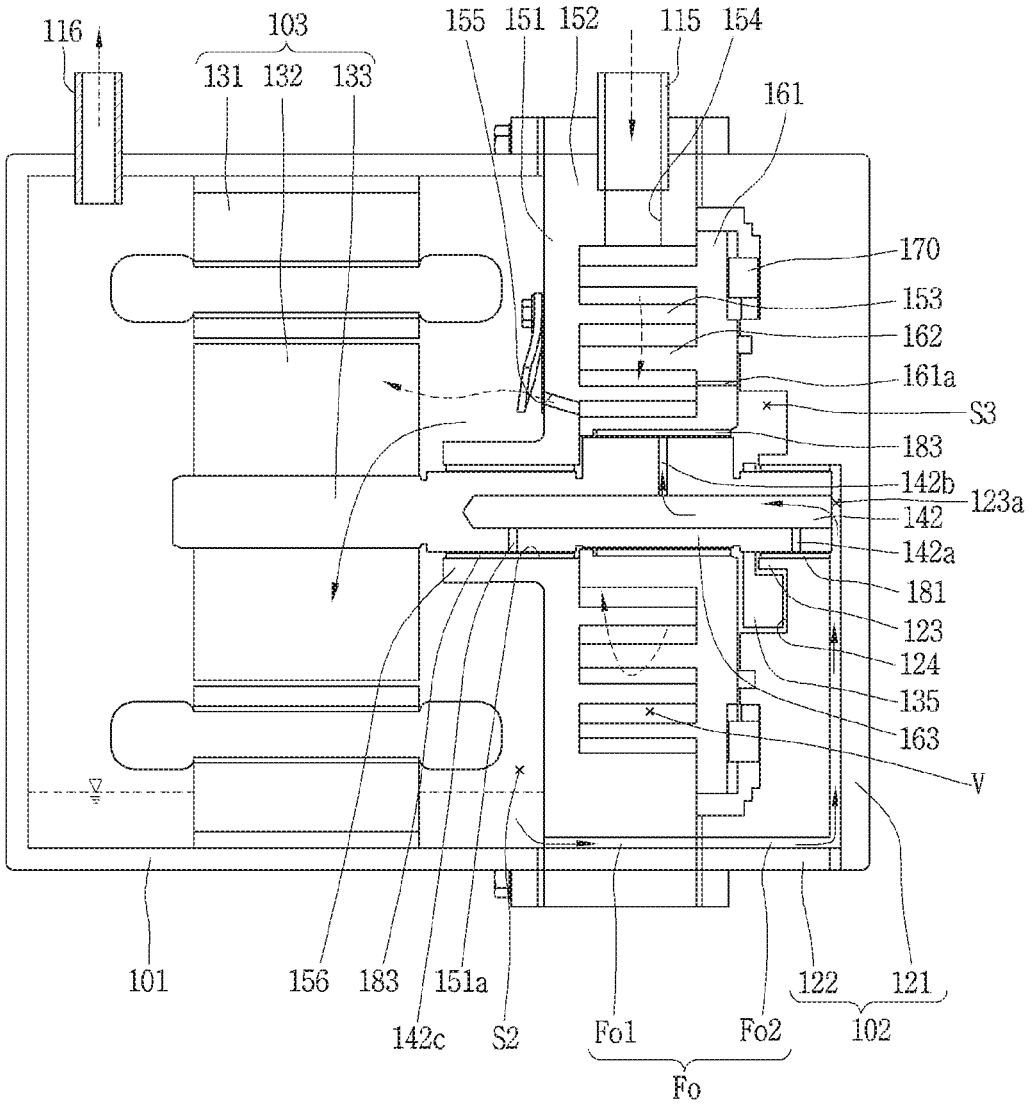
FIG. 5 is a schematic view for illustrating a process in which refrigerant and oil circulate in the motor-operated compressor of FIG. 1.

A circulation process of refrigerant and oil in the scroll compressor according to this embodiment is as follows. FIG. 5 is a schematic view for illustrating a process in which refrigerant and oil circulate in the motor-operated compressor of FIG. 1.

That is, refrigerant suctioned into the compression chamber V through the suction pipe 115 is compressed while moving toward the center of the compression chamber V. The refrigerant compressed in the compression chamber V is discharged to the discharge space S2 through the discharge port 155 together with the oil. The refrigerant and oil discharged into the discharge space S2 are separated from each other while passing through the discharge space S2. The refrigerant moves to the refrigeration cycle through the discharge pipe 116 connected to the exhaust port while the oil is collected on the floor. As the pressure in the discharge space S2 is higher than the pressure in the inner space 123*a* of the second shaft support part 123, the oil of the discharge space S2 moves into the second shaft support part through the first oil supply passage Fo1 and the second oil supply passage Fo2. This oil is supplied to the bearing surfaces B1, B2, and B3 through the oil flow path 142 and the oil supply holes 142*a*, 142*b*, and 142*c* of the rotary shaft 133 to lubricate the bearing surfaces. At the same time, some of the oil flows into the compression chamber V through the gaps between the bearing surfaces B1, B2, and B3. The oil having flowed into the compression chamber V lubricates a gap between the stationary wrap 153 and the orbiting wrap 162 constituting the compression chamber. Some of the oil moves into the intermediate pressure space S3 through the intermediate pressure hole 161*a* together with the refrigerant. The refrigerant and oil moving into the intermediate pressure space S3 form back pressure so that the second scroll 160 is supported toward the first scroll 150.

Thus, the second scroll 160 is suppressed from being spaced apart from the first scroll 150 even when the pressure of the compression chamber rises, thereby preventing axial leakage and improving compression performance.

However, under the condition that the back pressure is not sufficiently formed, for example, when the compressor is activated, the second scroll 160 may be spaced apart from the first scroll 150, thereby causing a compression delay and reducing the efficiency of the compressor.

In view of this, an elastic member may be provided between the second scroll 160 and the frame 102 to elastically support the second scroll 160 toward the first scroll 150.

Figure 6:
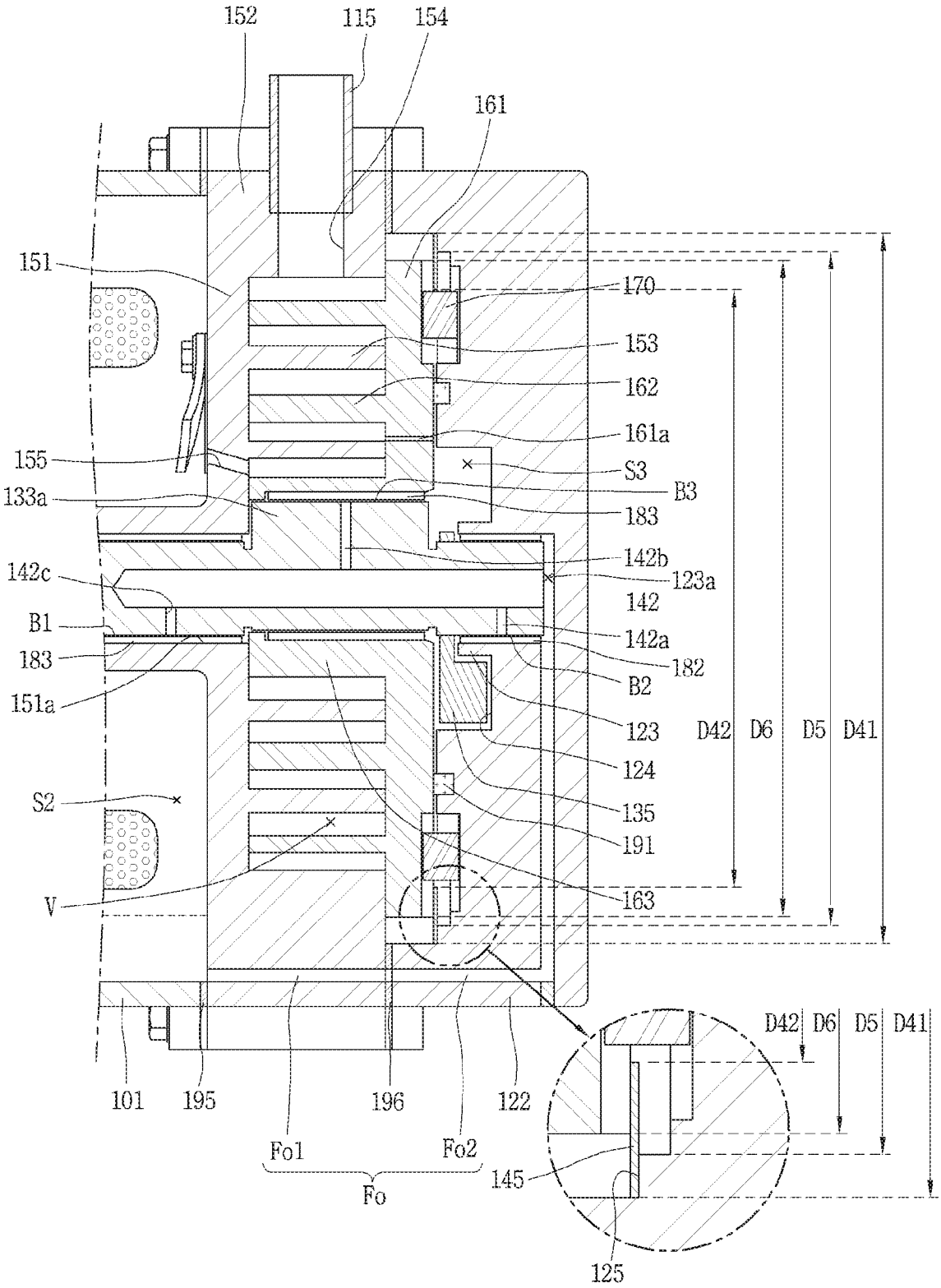
FIG. 6 is a cross-sectional view showing an example in which an elastic member is provided between a second scroll and a frame in the motor-operated compressor according to the present invention.
Figure 7:
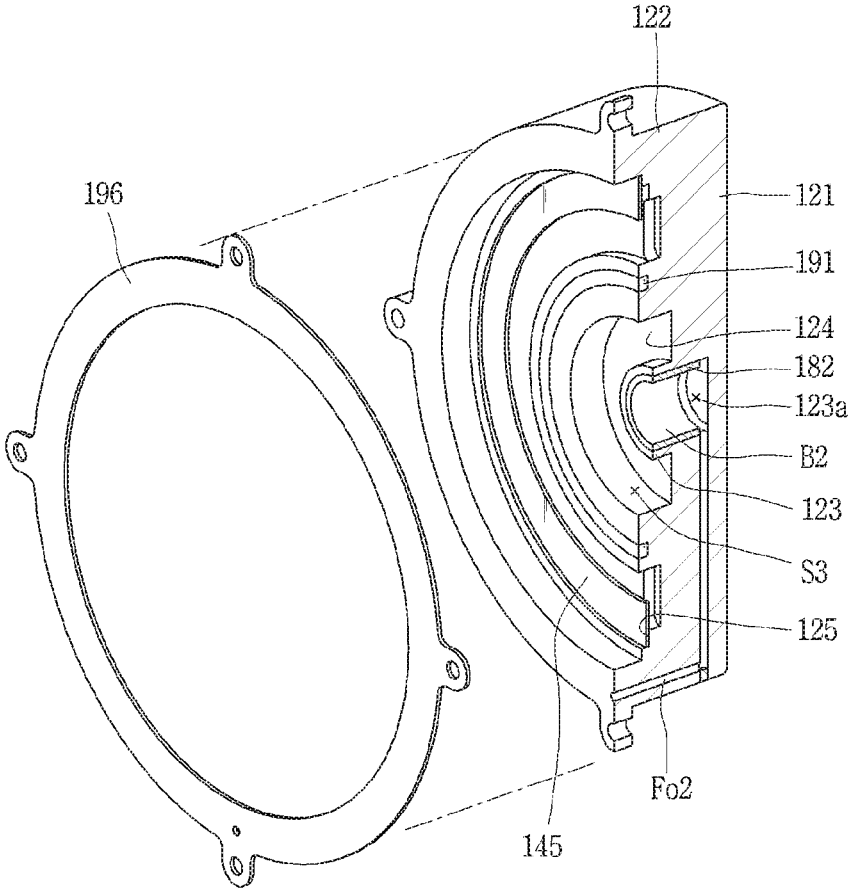
FIG. 7 is an exploded perspective view showing the inner surface of the frame of FIG. 6.
Figure 8A:
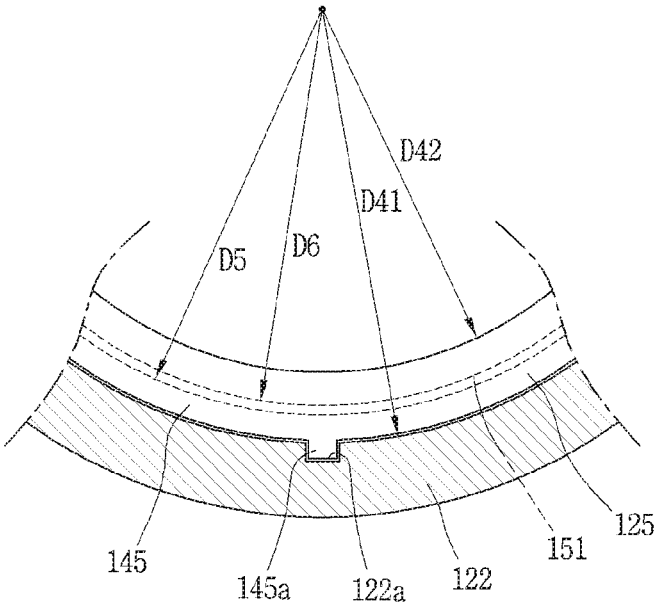
FIGS. 8A and 8B are front views partially showing examples in which the elastic member is coupled to the frame in FIG. 6.
Figure 8B:
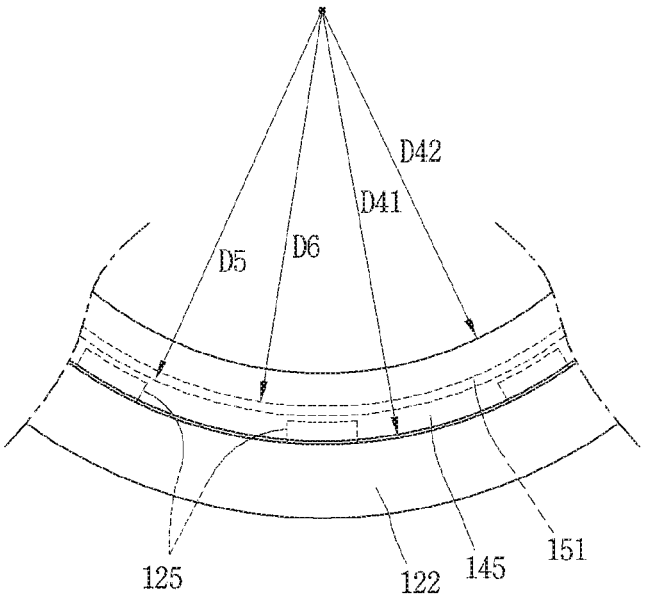

FIG. 6 is a cross-sectional view showing an example in which an elastic member is provided between a second scroll and a frame in the motor-operated compressor according to the present invention, FIG. 7 is an exploded perspective view showing the inner surface of the frame of FIG. 6, and FIGS. 8A and 8B are front views partially showing examples in which the elastic member is coupled to the frame in FIG. 6.

As shown in FIGS. 6 and 7, an elastic member 145 may be formed in a thin annular shape having predetermined elasticity and may have a rear outer periphery corresponding to a support surface 125 provided on the inner peripheral surface of the frame 102 and also a front inner periphery corresponding to the second scroll 160. The support surface 125 may be formed stepwise to have a predetermined height on a front inner surface of the frame 102. Thus, for the elastic member 145, the inner periphery supported by the second scroll 160 may have elasticity in a kind of leverage mode by using the outer periphery.

The outer diameter D41 of the elastic member 145 may be larger than the inner diameter D5 of the support surface 125 of the frame 102 and the outer diameter D6 of the orbiting end plate 161 while the inner diameter D42 of the elastic member 145 may be smaller than the inner diameter D5 of the support surface 125 of the frame 102 and the outer diameter D6 of the orbiting end plate 161. Thus, the elastic member 145 may have an elastic force between the frame 102 and the second scroll 160 to elastically support the second scroll 160 toward the first scroll 150. Then, even under the condition that the back pressure is not sufficiently formed, for example, even when the compressor is activated, the second scroll 160 may be suppressed from being spaced apart from the first scroll 150, thereby increasing the efficiency of the compressor.

Also, the elastic member 145 may flexibly move according to the movement of the second scroll 160 instead of being fastened to the second scroll 160 or the support surface 125 of the frame 102. In this case, the elastic member 145 may have one surface coming into contact with the frame 102 and another surface coming into contact with the second scroll 160. Thus, the elastic member 145 may be provided not to be fastened to the frame 102 or the second scroll 160. Thus, the elastic member 145 may perform a relative motion between the frame 102 and the second scroll 160, thereby acting as a kind of thrust bearing.

However, the elastic member 145 may be fastened to the second scroll 160 or the support surface 125 of the frame 102. For example, as shown in FIG. 8*a*, at least one fastening protrusion 145*a* is formed on the outer peripheral surface of the elastic member 145, and a fastening groove 122*a* may be formed on the corresponding inner peripheral surface of the frame side wall 122 so that the fastening protrusion 145*a* of the elastic member 145 may be inserted into the fastening groove 122*a*. Therefore, the elastic member 145 may be suppressed from being coupled to the frame 102 and circumferentially rotated. It will be appreciated that the fastening protrusion may be formed on the frame and that the fastening groove may be formed in the elastic member. Also, the elastic member 145 may be fastened using a small bolt or by welding.

Also, the support surface 125 may be formed in an annular shape as shown above, but the support surface 125 may be formed as a plurality of protrusions circumferentially arranged at regular intervals as shown in FIG. 8B. The elastic member 145 may be stably supported when the support surface 125 is formed in an annular shape. On the other hand, the elastic member 145 may be formed of a plurality of protrusions, the frictional area between the elastic member 145 and the support surface 125 may decrease, thereby reducing friction loss.

Meanwhile, another example of the motor-operated compressor according to the present invention is as follows.

Figure 9:
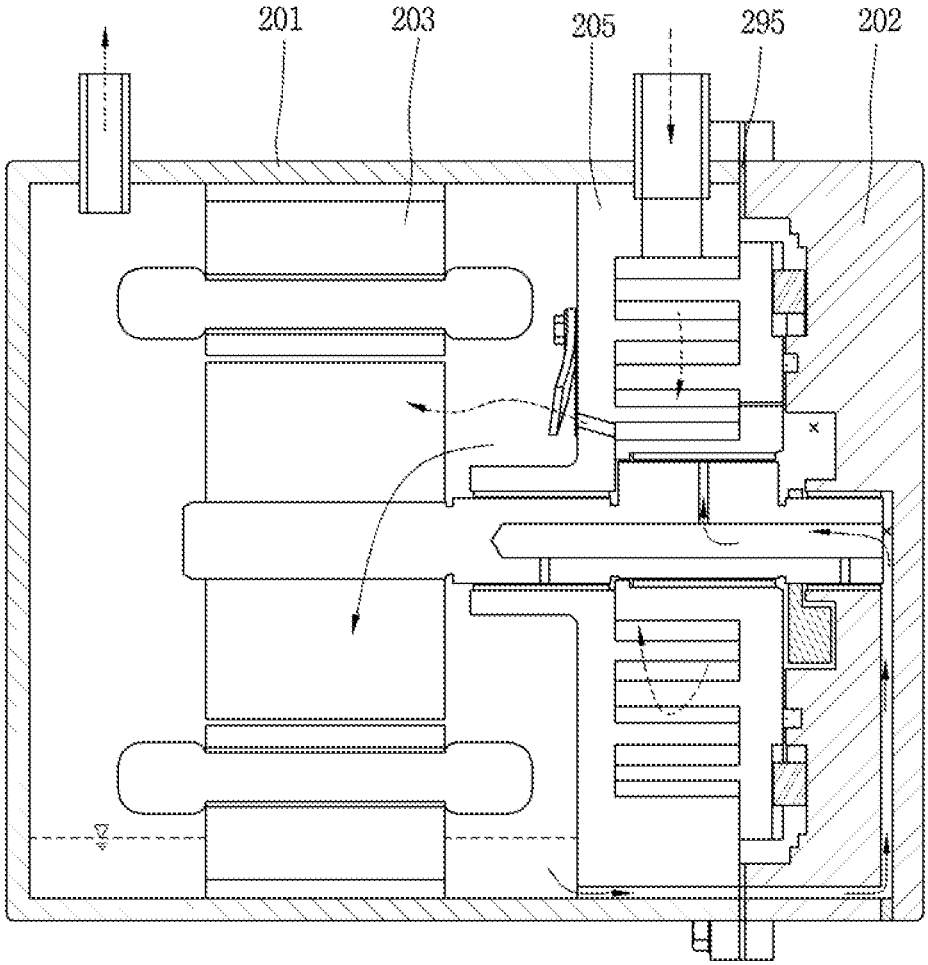
FIGS. 9 to 11 are schematic views showing motor-operated compressors according to other embodiments of the present invention.
Figure 10:
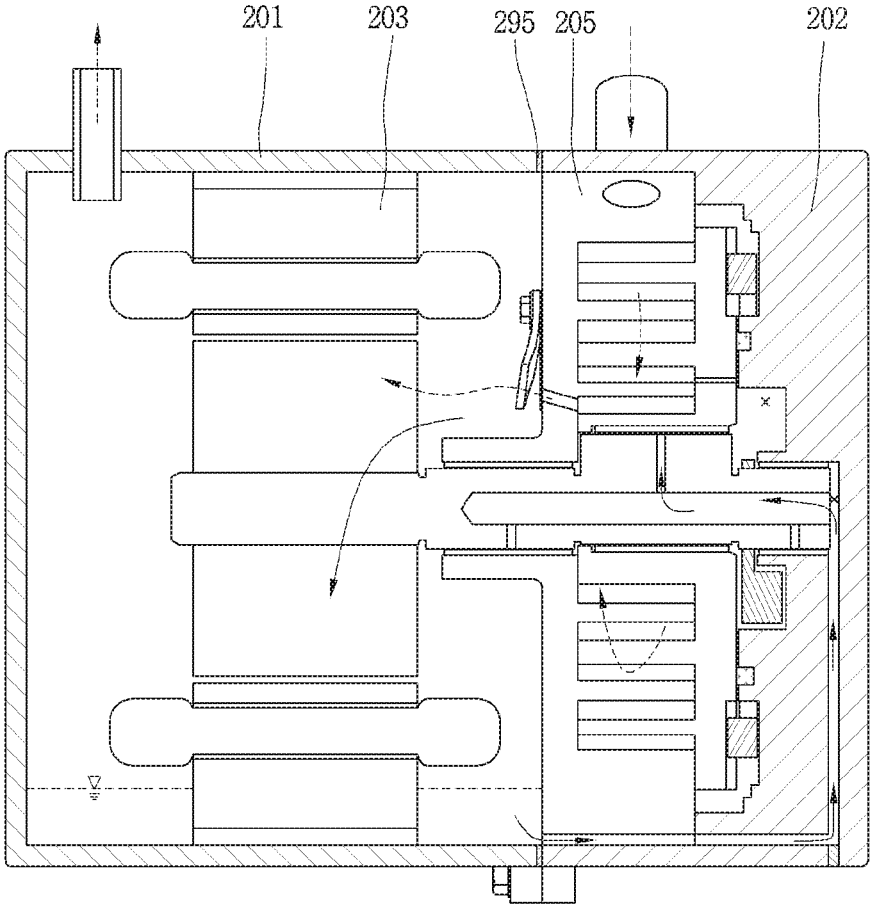
Figure 11:
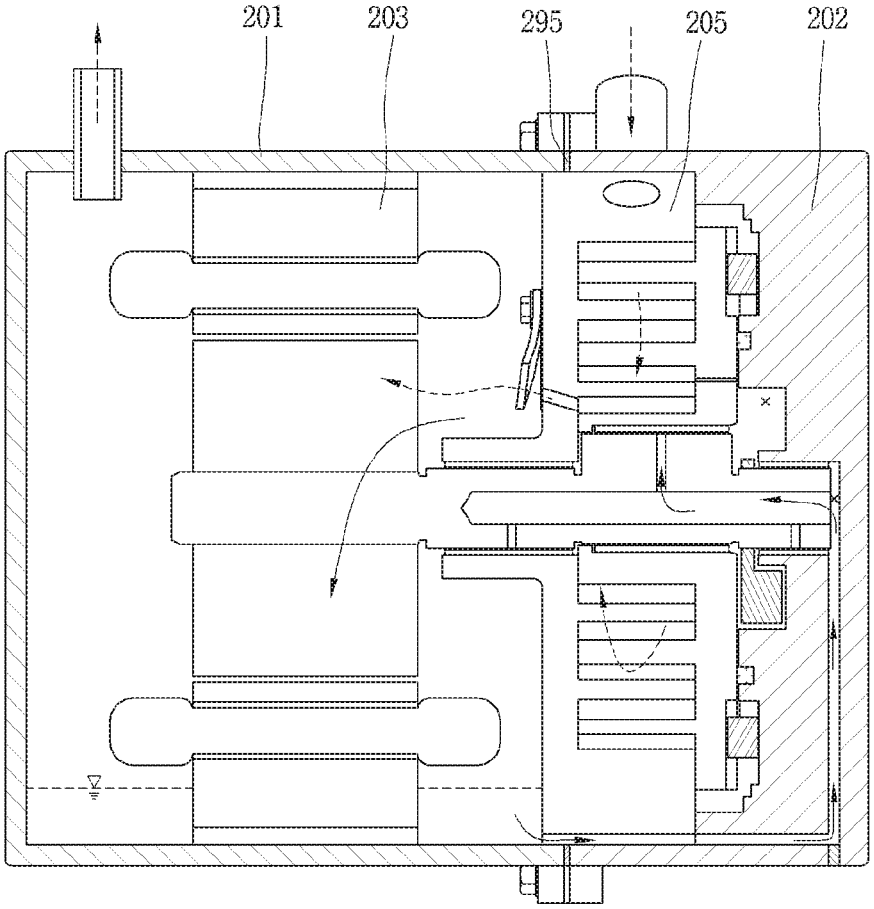

That is, in the above-described embodiment, the first scroll, which is a stationary scroll, is placed between the frame and the housing constituting the casing and exposed to the outside of the casing, but according to this embodiment, the compression part including the first scroll is installed to be accommodated in the casing. FIGS. 9 to 11 are schematic views showing motor-operated compressors according to other embodiments of the present invention.

As shown in the drawings, the scroll compressor according to these embodiments may include a housing 201, a motor part 203 provided in the inner space of the housing 201, a compression part 205 provided on one side of the motor part 203, and a frame 202 provided on one side of the compression part 205.

In this case, basic configurations of the housing 201, the motor part 203, the compression part 205, and the frame 202 are similar to those of the aforementioned embodiments, and thus a detailed description thereof will be omitted. However, in this embodiment, one end of the housing 201 may be coupled to one end of the frame 202 with a gasket 295 interposed therebetween or with the outer peripheral surface of the first scroll forming the compression part 205 interposed therebetween.

For example, as shown in FIG. 9, the whole compression part 205, including the first scroll, is fully inserted into the housing so that one end of the housing 201 may be coupled to one end of the frame 202. In this case, the suction pipe 115 may be connected, through the housing 201, to the suction hole provided in the compression part 205.

Also, as shown in FIG. 10, on the contrary to the above example, the whole compression part 205 is fully inserted into the frame 202 so that one end of the frame 202 may be coupled to one end of the housing.

Also, as shown in FIG. 11, the housing 201 may be coupled to the frame 202 while half of the compression part 205 is inserted into the housing 201 and the other half is inserted into the frame 202. In this case, the outer peripheral surface of the first scroll forming the compression part 205 may be welded to the housing 201 and the frame 202, or annular protrusions may be formed on the outer peripheral surface of the first scroll so the housing 201 and the frame 202 may be bolted on the annular protrusions.

As described above, when the housing 201 and the frame 202 come into close contact with each other to form the casing, only a portion where the housing 201 and the frame 102 are coupled is sealed, and thus. As a result, the sealing area is reduced as compared to the previous embodiments. Thus, it is possible to simplify a casing assembly process.

What is claimed is:

1. A motor-operated compressor comprising:

a housing;

a driving motor provided in an inner space of the housing, the driving motor having a stator and a rotor;

a rotary shaft coupled to the rotor;

a first scroll provided on one side of the driving motor, the rotary shaft passing through and rotatably coupled to the first scroll;

a second scroll coupled to the first scroll and coupled to an eccentric part of the rotary shaft passing through the first scroll, a compression chamber being formed between the first scroll and the second scroll;

a frame provided on an opposite side of the first scroll and the second scroll from the driving motor, the frame being configured to axially support the second scroll and radially support one end of the rotary shaft passing through the second scroll;

a discharge port is formed in the first scroll to discharge refrigerant compressed in the compression chamber, the discharge port being in fluid communication with the inner space of the housing;

a first bearing forming a bearing surface together with an outer peripheral surface of a portion of the rotary shaft provided in the first scroll;

a second bearing forming a bearing surface together with an outer peripheral surface of a portion of the rotary shaft provided in the second scroll;

a third bearing forming a bearing surface together with an outer peripheral surface of a portion of the rotary shaft provided in the frame, and an oil flow path and an oil supply hole formed in the rotary shaft to supply oil to the bearing surfaces, wherein, the rotary shaft includes an oil flow path extending axially into one end of the rotary shaft, and an oil supply passage extends between the oil flow path and the inner space of the housing and passes through the first scroll and the frame.

2. The motor-operated compressor of claim 1, wherein the oil supply passage comprises:

a first oil supply passage passing through the first scroll; and a second oil supply passage passing through the frame, the second oil supply passage being in fluid communication with the first oil supply passage.

3. The motor-operated compressor of claim 2, wherein, the frame includes a shaft support part radially supporting one end of the rotary shaft, and the second oil supply passage is in fluid communication with the oil flow path through the shaft support part.

4. The motor-operated compressor of claim 3, wherein a gap between the first oil supply passage and the second oil supply passage is sealed by a sealing member.

5. The motor-operated compressor of claim 1, wherein an intermediate pressure space is formed between the second scroll and the frame, and the oil supply passage is separated from the intermediate pressure space.

6. The motor-operated compressor of claim 1, wherein an intermediate pressure space is formed between the second scroll and the frame, and the oil supply passage is in fluid communication with the intermediate pressure space.

7. The motor-operated compressor of claim 1, further including an elastic member disposed between the second scroll and the frame, the elastic member being configured to elastically support the second scroll in a direction toward the first scroll.

8. The motor-operated compressor of claim 7, wherein the frame includes a support surface forming a step at a predetermined height from an inner surface of the frame and configured to support an outer periphery of the elastic member.

9. The motor-operated compressor of claim 8, wherein the elastic member is fastened to the frame by a protrusion of one of the elastic member and the frame and a groove of the other of the elastic member and the frame mated with the protrusion.

10. The motor-operated compressor of claim 8, wherein the elastic member is elastically supported between the second scroll and the frame.

11. The motor-operated compressor of claim 1, wherein an intermediate pressure space is formed between the second scroll and the frame, and the intermediate pressure space is in fluid communication with the compression chamber.

12. The motor-operated compressor of claim 11, further including a balance weight coupled to the rotary shaft and accommodated in the intermediate pressure space.

13. The motor-operated compressor of claim 1, wherein the first scroll is coupled to the housing along one axial surface and coupled to the frame along another axial surface.

14. The motor-operated compressor of claim 13, wherein the first scroll has an outer diameter greater than or equal to at least one of an inner diameter of the housing or an inner diameter of the frame.

15. The motor-operated compressor of claim 1, wherein the first scroll has an outer peripheral surface coupled to at least one of an inner surface of the housing or an inner peripheral surface of the frame.

* * * * *